United States Patent [19]

McCarthy

[11] Patent Number: 4,972,947

[45] Date of Patent: Nov. 27, 1990

[54] MULTIPLE PEN CADDY FOR CHILDREN AND ARTISTS

[75] Inventor: Gerald A. McCarthy, Carmichael, Calif.

[73] Assignee: Tessa J. McCarthy, Carmichael, Calif.

[21] Appl. No.: 405,690

[22] Filed: Aug. 28, 1989

[51] Int. Cl.[5] ..... A47F 7/00; B43M 17/00

[52] U.S. Cl. ..... 206/214; 206/224; 206/371; 211/69.1; 211/69.3

[58] Field of Search ..... 206/214, 224, 371, 1.7, 206/443; 211/60.1, 69.1, 69.2, 69.3, 69.5, 70

[56] References Cited

U.S. PATENT DOCUMENTS

| | | | |
|---|---|---|---|
| 421,352 | 2/1890 | DeWeese et al. | 211/70 X |
| 561,243 | 6/1896 | Temple | 211/70 X |
| 2,488,087 | 11/1949 | Kravitt | 211/70 X |
| 2,500,115 | 3/1950 | Burlin | 211/70 |
| 2,604,557 | 7/1952 | Nelson | 211/69.1 X |
| 3,428,380 | 2/1969 | Danjczek | 206/371 X |
| 4,134,525 | 1/1979 | Respoli | 206/1.7 |
| 4,176,743 | 12/1979 | Fitzpatrick | 206/214 |
| 4,773,544 | 9/1988 | McCarthy | 206/371 X |

FOREIGN PATENT DOCUMENTS

| | | | |
|---|---|---|---|
| 273434 | 7/1927 | United Kingdom | 211/205 |

*Primary Examiner*—Paul T. Sewell
*Assistant Examiner*—Jacob K. Ackun, Jr.
*Attorney, Agent, or Firm*—Mark C. Jacobs

[57] ABSTRACT

A multiple pen caddy for pens having a shoulder or ring on the pen cap wherein the pens are stored cap down-barrel up, wherein the shoulder or ring of the barrel of each pen cooperates with a part of the caddy to permit one hand removal and replacement of each pen's barrel within its cap. The caddy may assume many configurations and hold any number of pens, the number being limited only by the physical size of the product.

12 Claims, 2 Drawing Sheets

MULTIPLE PEN CADDY FOR CHILDREN AND ARTISTS

BACKGROUND OF THE INVENTION

Two problems all too often encountered by artists, preschool and school age children and all other persons who use a multiplicity of pens in close proximity of time are: (1) where is the cap for a pen and (2) where is the green cap for the green pen, when a multiplicity of pens are used.

All too often pens get mismatched tops placed on them. This is not only unsightly, but can lead to premature drying of felt tip pens because the brand A cap is not a perfect fit for a brand B barrel, thereby letting air reach the felt tip or rolling ball and dry it out.

Ofttimes a pen cap will fall to the floor, or be swept under the user's work papers only to become misplaced for what seems like a year. Thus there is a need for a product that prevents felt tip dry out, and which prevents the top from a pen from becoming mislaid.

It is an object therefore to provide a product that fits on a desk and which can hold a plurality of pens which normally lie around on the desk.

Another object is to provide a product wherein the pen's cap cooperates with the product to permit one handed access and replacement of the pen barrel into its respective cap.

Yet another object is to provide a product that can hold a plurality of different colored pens.

Still another object is to provide a product that is capable of holding a first brand or style of pens and which by suitable adjustment thereof, it can be modified to hold a second brand or style of pens.

Other objects of the invention will in part be obvious and will in part appear hereinafter.

The invention accordingly comprises the features, properties and the relation of components which are exemplified in the following detailed disclosure, and the scope of the application of which will be indicated in the claims.

For a fuller understanding of the nature and objects of the invention reference should be made to the following detailed description taken in conjunction with the accompanying drawings.

SUMMARY OF THE INVENTION

A multiple pen caddy is disclosed, which is useful for artists, draftsmen, and students or any desk use wherein the pens are retained cap down-barrel up and wherein the cap cooperates with the caddy to permit one handed removal and replacement of pens from the caddy.

DESCRIPTION OF THE PREFERRED EMBODIMENT

Figure 1:
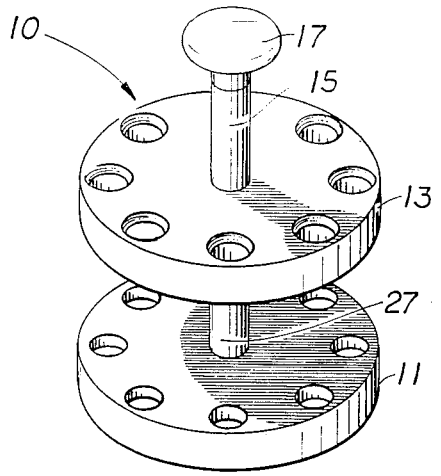
FIG. 1 is a perspective view of a first embodiment of this invention,,n.
Figure 2:
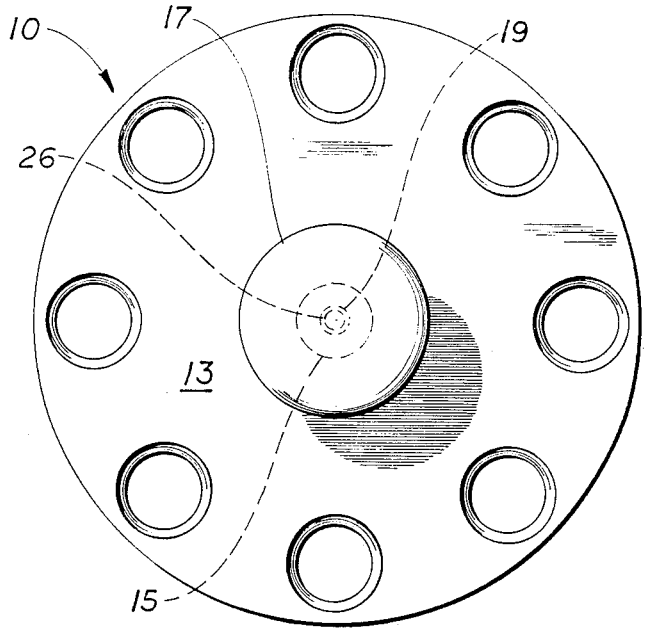
FIG. 2 is a top plan view of the device shown in FIG. 1.
Figure 3:
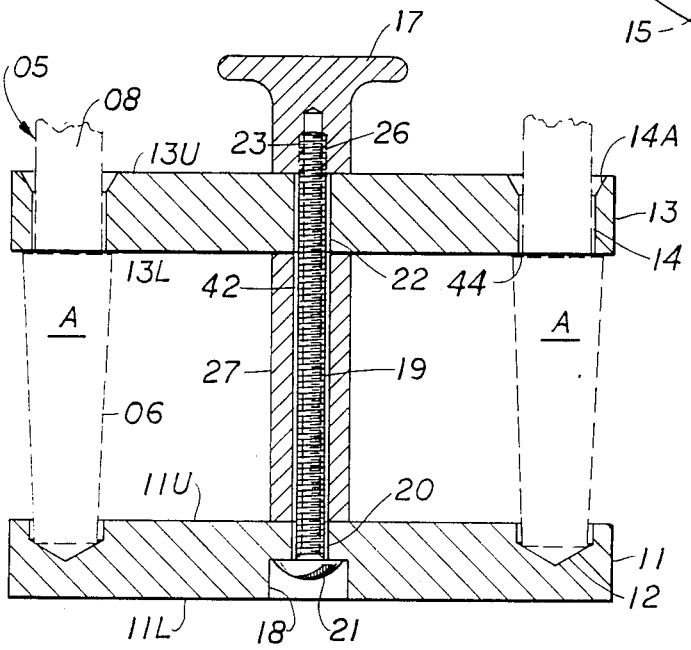
FIG. 3 is a sectional view of one embodiment of the invention.

The multiple pen caddy and carrying device 10 of this invention is seen in the first embodiment in FIGS. 1 through 3. Caddy 10 has as its main elements a bottom plate 11 spaced from a top plate 13. A optional tubular riser 15 is mounted on the top surface of plate 13 and superposed on the riser 15 is a knob 17 which may also be integral with it. These are all retained in the spaced relationship shown in FIG. 3 by a threaded bolt 19, or other retaining means.

In detail, bottom plate 11 includes a plurality of recesses 12 formed in the upper surface of the bottom plate (see FIG. 3). Recess 12 is generally circular in cross section, or it can be made concave hemispherically, or it may taper to a point. The recess 12 is made to a first depth usually about $\frac{1}{4}''$ deep and about $\frac{1}{2}''$ in diameter. The number of recesses 12 can vary according to the diameter of the plate 11. Obviously the number of laterally spaced first recesses 12 in the bottom plate 11 has to correspond to the number of bores 14 in the top plate 13.

Center counterbore 18 in bottom plate 11 extends inwardly from lower surface 11L of said plate 11 at least $\frac{1}{4}''$. Throughbore 20 concentric with counterbore 18 and of a smaller diameter extends through bottom plate 11.

Top plate 13 may be of the same, smaller, or of a greater diameter than bottom plate 11. The only requirement is the throughbores 14 align with recesses 12 in the bottom plate such as to be able to receive the pens 05. Top plate 13 may be thicker, thinner or of the same thickness as bottom plate 11.

Throughbores 14 are sized in diameter to receive pens 05. A downwardly and inwardly beveled chamfered cutaway area 14A may extend from surface 13U about $\frac{1}{8}''$ deep and communicate with bores 14.

Top plate 13 further includes a central throughbore 22 of a cross section sufficient to pass threaded bolt 19 therethrough. Optional tubular riser 15 shown in place in the FIG. 4 embodiment is disposed over throughbore 22 and is seen to be optionally interposed between top plate 13 and knob 17. Its disposition is recommended particularly when a long rise is employed as is seen in FIG. 1, as access to knob 17, is easier if said knob is not located down between the upstanding pens 05, per FIG. 3, but is spaced up from plate 13. The tubular riser 15 may vary in height from about $\frac{1}{2}''$ to about $1\frac{1}{2}''$ and is of a cross section of about $\frac{1}{2}''$. Tubular riser 15 has an elongated central bore 24 of about $\frac{1}{4}''$ to $\frac{3}{8}''$ in diameter which bore is sized to pass threaded bolt 19 therethrough. Tubular riser 15 could also be made integral with plate 13, if desired.

Figure 4:
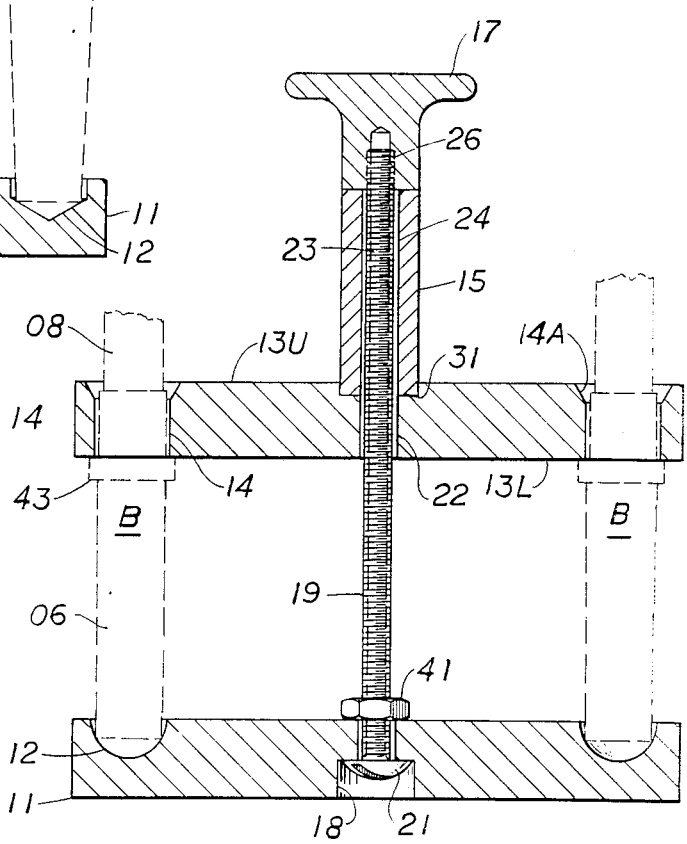
FIG. 4 is a sectional view similar to that of FIG. 3, but of a variant of the invention.
Figure 8:
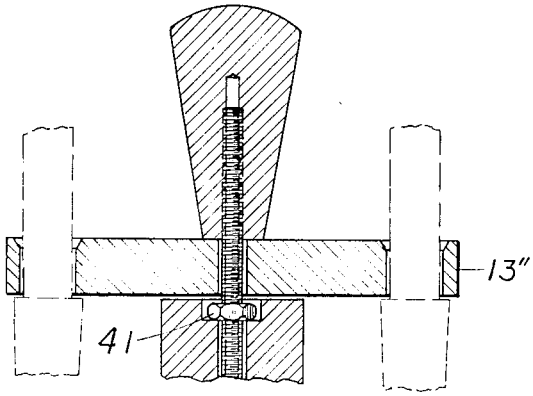
FIG. 8 is a partial sectional view of a modification of two elements of this invention.

Knob 17 can be any type of conventional drawer or cabinet pull or knob or specifically designed for this invention. It includes a threaded area 26 adapted to receive the threads 23 of bolt 19 or of a fastener specially made for this device, but not shown. Riser 15, per FIG. 4 is cylindrical or of any other cross section aesthetically compatible with knob 17 or integral therewith, per FIG. 8.

Optional spacer 27 may be interposed between plates 11 and 13. Tubular spacer 27's central bore 42 is of adequate cross section to pass bolt 19 therethrough. In disposition tubular spacer 27 extends upwardly from the upper surface 11U of plate 11. Spacer 27 could also be integral with plate 11, or top plate 13. Reference is made to FIG. 3.

For aesthetic purposes it is recommended that tubular spacer 27 be of substantially the same diameter as riser 15, if riser 15 is used.

To assemble caddy assembly 10, whether or not spacer 27 is employed, the bolt 19 is placed through counterbore 18 and throughbore 20. The head 21 of bolt 19 stops at the deepest point of counterbore 18 as per FIG. 3. The closed end of each pen cap 06 is placed into a recess 12 to serve as an indexing mechanism. While holding the plurality of pens between the fingers, plate 13 is lowered onto bolt 19 such that the open end of each cap 06 protrudes up to an opening 14 in plate 13 per FIG. 3 or until the upper edge of the inverted cap's collar 43 of pen B is flush with 13L as per FIG. 4, or the shoulder 44 of pen A is flush with 13L per FIG. 3. After a wedge fit is made of the open ends of the caps against bottom surface 13L, tubular riser 15 is placed above the plate 13 onto bolt 19, and the threads 26 in knob 17 are threaded onto the threads 23 of said bolt, to thereby complete the assembly of device 10. In order to differentiate the two types of pens utilizable herein, those with the collar are designated pen B and are seen in FIG. 4; while the shouldered cap type is designated type A and is shown in FIG. 3. Either type of pen may be used with the holder of either FIG. 3 or FIG. 4, since plate 13, is common to both units.

While not shown in the third and forth figure it is contemplated by the inventor to include an annular recess 31 on the under surface of plate 13 to index and retain the riser is, and/or handle at a predetermined position. See FIG. 4. Such an annular recess is also contemplated on the underside of plate 13 to aid in the positioning of spacer 27. Obviously a corresponding recess to 31 may be placed in bottom plate 11 either in addition to or instead of recess 31.

Figure 9:
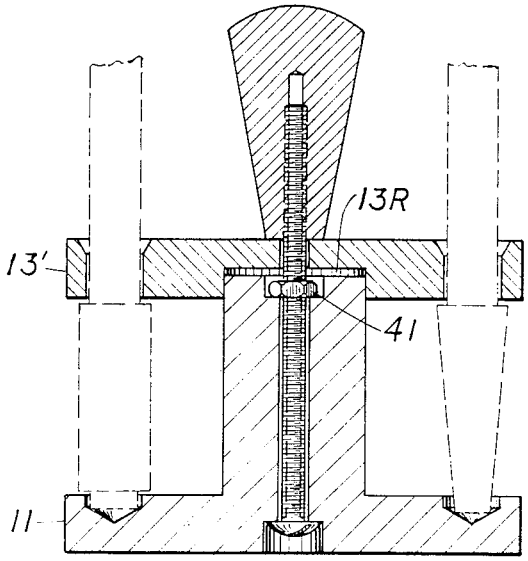
FIG. 9 is an elevational view of a variant of the device of FIG. 1.

If spacer 27 is not employed, and if the threads of threaded bolt 19 extend the full length of the bolt, a nut 41 may be employed in place of spacer 27 to help retain the bolt in the bottom plate for ease of assembly. The aforementioned nut, 41 would tighten bolt 19 on plate 11. See FIG. 4. Note also that spacer 27 could be internally threaded to accomplish the same purpose, or if integral with plate 11 would be counterbored to receive nut 41. See FIG. 9 for such a version wherein a recess is also provided in the underside of plate 13' and designated 13R.

Figure 5:
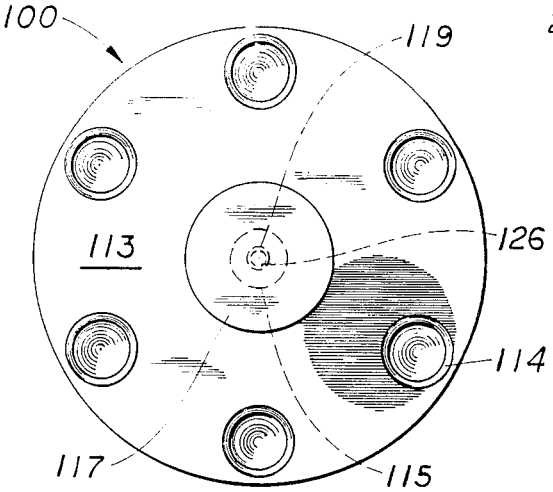
FIG. 5 is a top plan view of a third embodiment of this invention.

In the third embodiment of the invention, as seen in FIG. 5, which embodiment is designated 100, the features of the invention are similar to those of the first embodiment. Thus like numerals of the series utilized in the description of the first embodiment will be raised by 100 to describe similar parts of the second embodiment, i.e. 13 top plate is 113 top plate. All parts not identified specifically with respect to the second embodiment are the same as have previously been discussed.

Here embodiment 100 has a top plate 113 having a plurality, here six, of pen receiving bores 114. Handle 117 is shown mounted over tubular riser 115. Threads 126 of the handle 117 receive the threaded bolt 119.

The point of novelty in this embodiment relates strictly to the number of cap receiving bores 114, which as noted from the drawing; are 6 in number. All other features of the device in this embodiment need no further explanation as they are the same as the first embodiment.

While embodiments of a circular configuration have been shown, and wherein the number of cap receiving bores have been 6 and 8, it is readily seen that by enlarging the diameter of the top and bottom plates to accommodate more pens, even larger numbers of pens can be stored herein.

Figure 6:
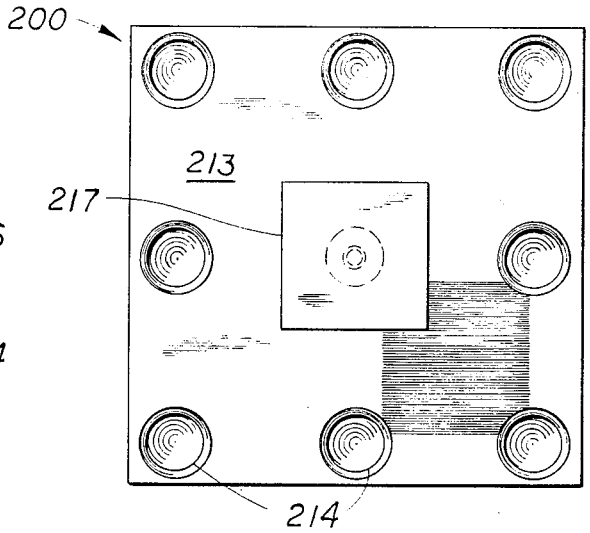
FIG. 6 is a top plan view of a variant of the device of this invention.
Figure 7:
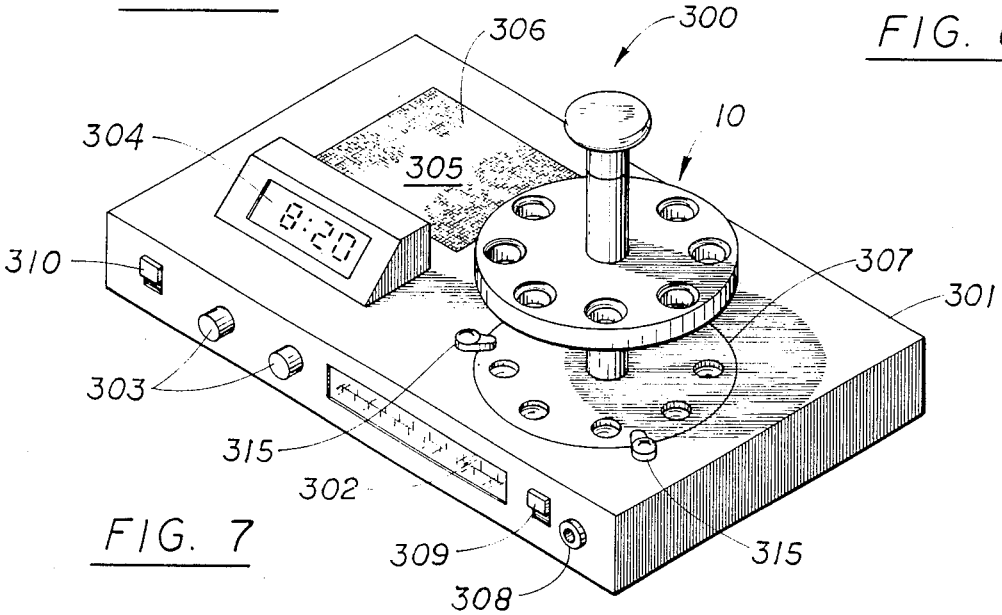
FIG. 7 is a perspective view of a desk accessory that incorporates the embodiment of FIG. 1 therein.

It is also to be seen that there is no criticality to using a circular disc for the top and bottom plates. Thus FIG. 6, illustrates embodiment 200 wherein as in the FIG. 5 embodiment six cap receiving bores are to be found. Top plate 213 however is seen to be of a square configuration and to have 6 bores 214. Naturally for the sake of aesthetics the bottom plate should preferably be of the same configuration. Such a square shaped embodiment can also optionally include the variant of a tubular riser on the bolt as may be desired. Note square knob 217 used for aesthetics. Obviously this square embodiment can be elongated to be configured as a rectangle.

The invention is also to be seen to be capable of incorporation into other devices. Thus pen caddy 10 can be incorporated into an executive desk accessory 300 having a base 301. Dial 302 is for the radio which is controlled by knobs 303 and plays through speaker 305 behind the grille cloth 306 which is flush with the upper surface of the base 301. An optional clock 304 is also depicted as are a headphone jack 308 and headphone switch 309. Power is controlled by switch 310.

As can be readily understood bottom plate 11 is nested into a cutout 307 in base 301. This fit can be a friction fit for ready removal of pen caddy 10, or said holder can be permanently secured therein as by adhesive, bolting or the like as is commonly understood in the assembly art. The mode of actual assembly is not critical. Pivoting or rotatable retention latches 315 may also be employed for this purpose. Both such latches are deemed conventional.

Previously we have discussed the assembly of the first embodiment of the invention. All of the others assemble in like fashion.

The products of this invention may be made from any suitable materials. Thus the top and bottom plates may be made from ultra high molecular weight polyethylene, while the tubular riser, and spacer can be made from polyvinyl chloride or A.B.S. plastic. The handle may be made from any threadable plastic, wood, metal or ceramic. The threaded bolt may be of steel or aluminum or plastic. The nut may be nylon or metal.

It if further to be seen that other materials can be employed for each of these components. Thus the two plates could be made of metal or wood or other plastic.

The mode of assembly has been discussed previously. Should the unit loosen up through usage, or if a replacement pen is needed, such can be readily accomplished. Tightening of knob 17's threaded area 26 onto the threads 23 of bolt 19 causes pressure upon upper plate 13, against the shoulder 44 or collar 43 of pens A and B respectively to thereby clamp the pen caps between the two plates.

The products of this invention are intended to hold all of one brand of "large"—about ½"—felt tipped marker pens at any one time. These pens are used by artists and school children. Such pens often have water based ink and are used for charts and oversized drawings. The diameter of the cap of these various pens may vary slightly from brand to brand. Since there is this variance, the diameter of the cap receiving bore such as 14 can influence which pens can be utilized with the product. Thus it is preferred to make these bores at least a ½ inches across in order to maximize this pen, holding (per cap receiving capability).

Typical pen manufacturers of "large" felt tipped pens include Crayola and Sanford among others. The use of various combinations of bore sizes and clip recesses in the upper and lower plates will result in pen holders that can accommodate several different brands or types of pens rather than just one type of brand.

The pen holder of this invention not only permits one kind accessing of any particular pen, but also prevents pen caps from getting misplaced or lost.

The products of this invention are sure to find favor with artists, elementary school children and their teachers, as well as any other person who does multicolor drawing, charting or graphing using large felt tipped pens.

While not shown in drawings, rubber feet may be applied or integrally molded to the underside of the bottom plate for added stability. Also any one or more colored pigments and parts may be used to color the various parts of this product. Hot stamping and decals for decoration are also contemplated as decoration means.

While all of the pens in the embodiment shown are uniformly spaced from the central throughbore, such is not a requirement thus some could be spaced a greater distance from the outside edge of the plates.

Since certain changes may be made in the above product without departing from the scope of the invention herein involved, it is intended that all matter contained in the above description and shown in the accompanying drawings shall be interpreted as illustrative and not in a limiting sense.

I claim:

1. A multiple pen caddy for easily accessing felt tip pens, rolling ball and other pens needing their caps replaced between uses to prevent premature performance deterioration which pens include a barrel having a point at one end, and a cap with a shoulder or collar thereupon, said multiple pen caddy comprising a pair of spaced plates, one being a top plate and the other a bottom plate, both of which include a central throughbore;

the top plate having a plurality of peripheral throughbores each spaced inwardly from the outside edge of said plate, the bottom plate having an upper surface having a plurality of circular recesses corresponding in number to the number of peripheral throughbores of said top plate, the top plate throughbores being circular and sized in diameter to receive a cap of a pen, wherein each recess of the bottom plate is vertically aligned with a respective peripheral throughbore of the top plate;

a threaded bolt disposed in said central throughbore in said bottom plate and having a shaft passing through the central throughbore of each of said top and bottom plates whereby when one or more pen caps having a shoulder or collar at the open end thereof are disposed in said recesses of said bottom plate, and the open end of said caps are placed in the peripheral throughbores at the time the top plate is placed on said threaded bolt, said top plate will impinge upon said shoulder or collar and thereby maintain a spaced relationship with said bottom plate, such that a user can with one hand insert pens into respective caps, and the caps will be retained between the top plate and the bottom plate, due to cooperation between said caps and said plates to prevent removal of said caps.

2. The multiple pen caddy of claim 1 further including a spacer disposed on said threaded bolt and interposed between said top and bottom plates.

3. The pen caddy of claim 2 wherein the top plate has an annular recess on its upper surface sized to receive a knob.

4. The pen caddy of claim 1 wherein the top plate's peripheral throughbores include a tapering outward area in communication therewith.

5. The pend caddy of claim 4 wherein the top plate and bottom plate are of a circular configuration and said top plate's plurality of peripheral throughbores ranges from 6 to 8 in number, and the bottom plate's plurality of first recesses is the same number within the range of 6 to 8.

6. The pen caddy of claim 1 wherein the configuration of the top and bottom plate is rectangular.

7. The pen caddy of claim 1 wherein the bottom plate is disposed within the top surface of a housing for a radio.

8. The multiple pen caddy of claim 2 including a tubular riser disposed on said threaded bolt above said top plate.

9. The multiple pen caddy of claim 1 including a tubular riser having a central opening of a diameter to pass over said thread bolt's shaft and interposed between said top plate and;

a threaded knob adapted to receive the threaded end of said threaded bolt.

10. The multiple pen caddy of claim 1 wherein the bottom plate has an upper surface and a lower surface, and including a nut threaded onto said bolt, said nut abutting the upper surface of said bottom plate.

11. The multiple pen caddy of claim 2 wherein the spacer is integral with the bottom plate.

12. The multiple pen caddy of claim 8 wherein the tubular riser is integral with a knob, said knob being engaged with said bolt.

* * * * *